US005323804A

United States Patent [19]

Lin

[11] Patent Number: 5,323,804

[45] Date of Patent: Jun. 28, 1994

[54] BUG-PROOF AND ODOR-PROOF DRAINING OUTLET STRUCTURE

[76] Inventor: Chin-Hsi Lin, No. 12, Lane 297, Fu Pei Rd., Ho Mei Town, Changhua Hsein, Taiwan

[21] Appl. No.: 92,820

[22] Filed: Jul. 19, 1993

[51] Int. Cl.[5] ..... F16L 5/00

[52] U.S. Cl. ..... 137/362; 137/527.8; 251/212

[58] Field of Search ..... 251/212; 137/527.8, 137/362

[56] References Cited

U.S. PATENT DOCUMENTS

| | | | |
|---|---|---|---|
| 543,182 | 7/1895 | Hunt | 251/212 |
| 1,771,770 | 7/1930 | Bruno | 137/362 |
| 2,721,678 | 10/1955 | Gill | 251/212 |
| 3,592,240 | 7/1971 | Hedrick | 251/212 |
| 4,098,287 | 7/1978 | Baumbach | 137/362 |
| 4,178,638 | 12/1979 | Meyer | 251/212 |
| 4,870,992 | 10/1989 | Irwin et al. | 137/362 |
| 5,101,855 | 4/1992 | Tammera | 251/212 |

*Primary Examiner*—A. Michael Chambers
*Attorney, Agent, or Firm*—Browdy and Neimark

[57] ABSTRACT

An improved bug-proof and odor-proof draining outlet structure is particularly adapted for use on floors and is equipped with a pair of symmetric semi-circular blockage flaps that are pivotally fixed at the bottom periphery of the draining outlet and are one-way openable. At one side of each flap is disposed a counterweight so that as water is discharged via the blockage flaps, the same will be pushed opened, permitting water to be expelled out, and then automatically closed due to gravity exerted on the counterweights. Water is directly discharged into a duct without moving against the wall of the duct so as to make the discharge of the water in a more smooth and effective manner. Besides, the bottom periphery of the draining outlet is provided with a pair of supporting lugs each having a slot-like opening so that a pivot pin fixed to the underside of each blockage flap can be in snap engagement with each supporting lug with ease.

1 Claim, 3 Drawing Sheets

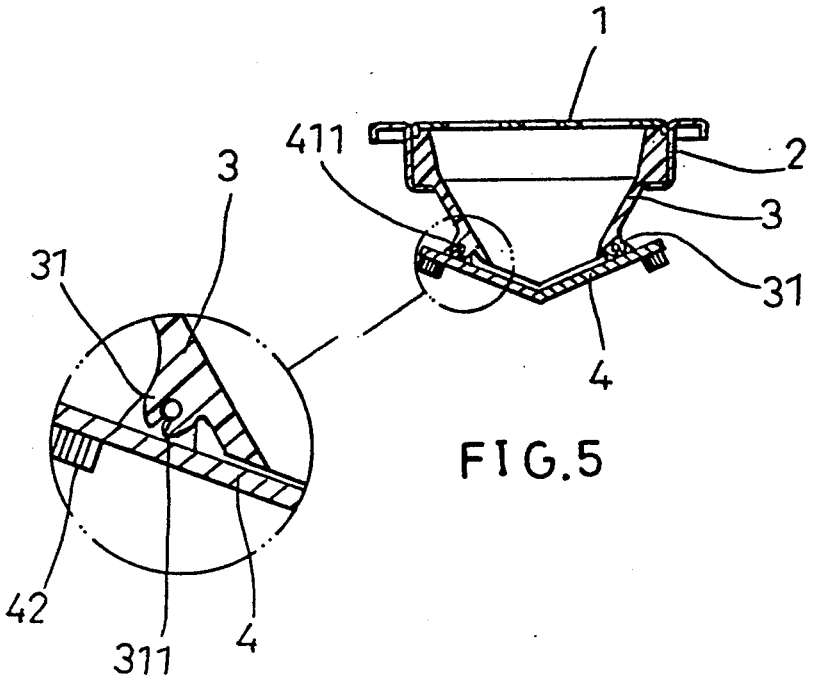
FIG.5
FIG.5A
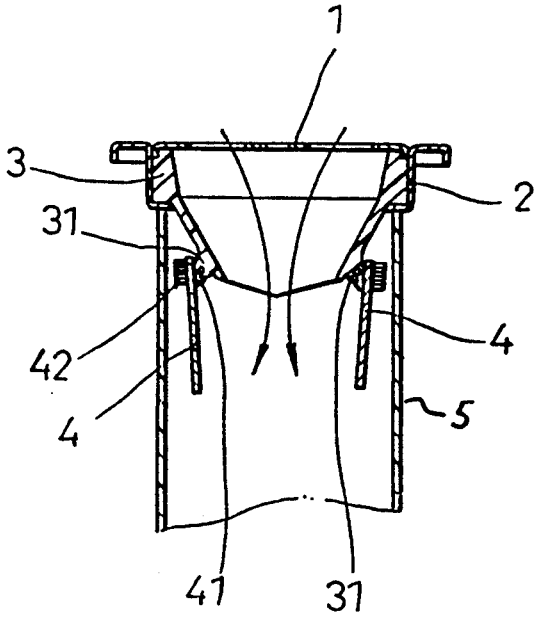
FIG.6

BUG-PROOF AND ODOR-PROOF DRAINING OUTLET STRUCTURE

BACKGROUND OF THE INVENTION

The present invention relates to a bug-proof and odor-proof draining outlet structure which is equipped with one or two one-way openable flaps pivotally secured with one side thereof to the periphery of a draining outlet so that bugs or mice can not get into a house via the draining outlets from discharge pipes or ducts in one aspect and odor in the pipes or ducts will be blocked from coming into a house through the discharge outlets in another.

In general, floors of bathrooms, kitchens are provided with draining outlets so as to permit water on the floors to be easily drained out. Such outlets are covered with a cap having a plurality of drainage holes thereon, as shown in FIG. 1. It is very annoying to find that bugs or insects can crawl into a house via the drainage holes; and odor from the draining pipes or ducts will also be spread over the house via such outlets.

As shown in FIGS. 2, 3, there is a prior art draining outlet having a fixing board 1 having a central draining outlet 2 associated therewith. At the top of the draining outlet 2 is disposed a common cap 3 having a plurality of drainage holes disposed thereon. A one-way openable blockage flap 4 pivotally secured to the bottom periphery of by way of a pin and lugs. A counterweight 41 is attached to the reverse side of the flap with respect to the pivot pin so that the flap can always resume its blocking position after each draining operation, and the periphery of the bottom of the draining outlet 2 is well sealed. Thus, bugs or odor in the ducts or pipes can be effectively blocked out. As further shown in FIG. 3, however, the one-flap outlet has a disadvantage that the discharged water will be led to flush against the wall of the pipe or duct, and some of the water will bounce back, causing turbulance in the flow which attributes to the slow-down of the discharged water at the draining outlet. Besides, the mounting of the one piece blockage flap to the bottom of the draining outlet is relatively difficult; the pivot pin of the flap must be associated with a number of lugs disposed on the periphery of the draining outlet.

SUMMARY OF THE INVENTION

Therefore, the primary object of the present invention is to provide an improved draining outlet which has two pieces of symmetric semi-circular blockage flap which are disposed in such a manner that a circular blockage flap is formed when assembled together and they can only be one way opened.

Another object of the present invention is to provide an improved draining outlet which permits water to be effectively expelled without blockage.

One further object of the present invention is to provide an improved draining outlet equipped with a pair of symmetric semi-circular blockage flaps that can be mounted with readiness.

BRIEF DESCRIPTION OF DRAWINGS

FIG. 5A is a sectional diagram showing the closing of the draining outlet of the present invention;

FIG. 5B is a diagram showing the mounting of one of the pivotal blockage flaps;

FIG 6 is a sectional view showing the pivotal opening of the two symmetric blockage flaps.

DETAILED DESCRIPTION OF PREFERRED EMBODIMENT

Figure 1:
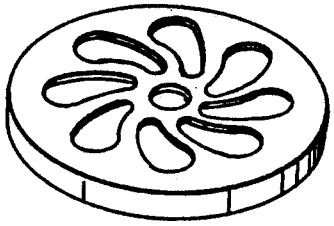
FIG. 1 is a conventional draining outlet.
Figure 4:
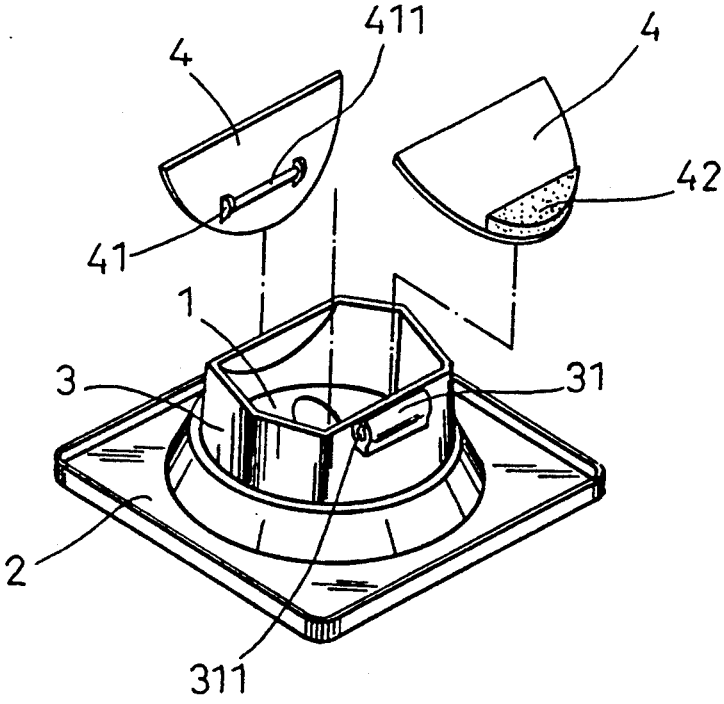
FIG. 4 is a perspective diagram showing the exploded components of the present invention.
Figure 2:
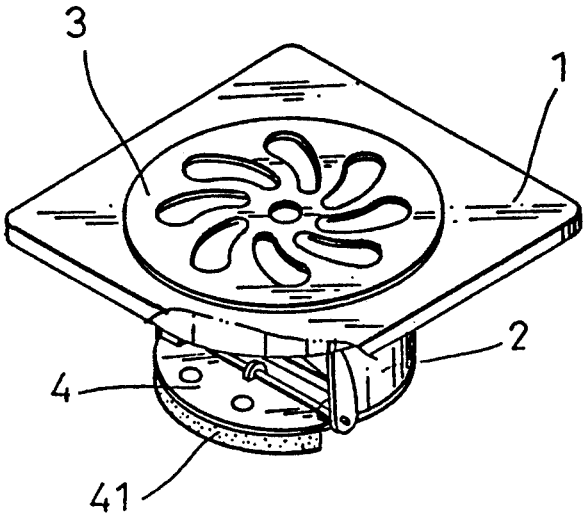
FIG. 2 (PRIOR ART)
FIG. 2 is another prior art draining outlet.
Figure 3:
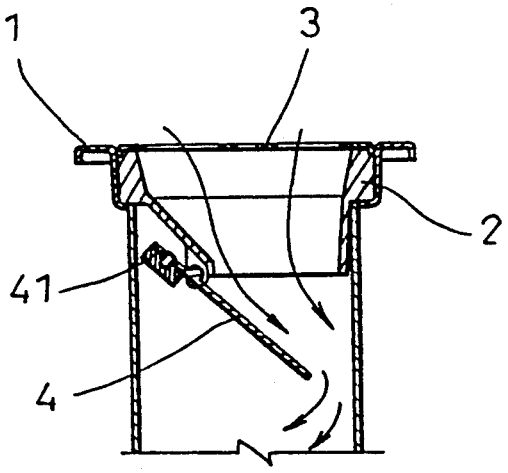
FIG. 3 (PRIOR ART)
FIG. 3 is a diagram showing the pivotal opening of the one piece blockage flap of FIG. 2.

Referring to FIG. 4, the present invention is comprised of a fixing board 2 which is made of stainless steel and is forged into shape. A central through hole is disposed on the fixing board 2 so as to permit a plastic draining outlet 3 to be attached thereto. The top of the draining outlet 3 is equipped with a top cap 1; and a pair of supporting lugs 31 are symmetrically fixed on the bottom periphery thereof. Each supporting lug 31 has a slot-like opening 311 so as to permit of the engagement of a pivot pin 411, fixed at the underside of a semi-circular blockage flap 4 by way of supporters 41, with each supporting lug 31, making the same to be one way pivotally openable.

As shown in FIG. 5B, the pivot pin 411 of each blockage flap 4 is pushed through the slot-like opening 311 into snap engagement with the supporting lug 31. Each blockage flap 4 has a counterweight 42 disposed at one side thereof so as to permit the flap 4 to be automatically pivoted into a closing position as a result of the gravity on the counterweight 42, as shown in FIG. 5A. The two blockage flaps 4 are one way openable, as shown in FIG. 6 so that discharged water can push the blockage flaps 4 downwardly opened when water drains out, and the flaps 4 can automatically pivot clockwisely and counterclockwise to get the draining outlet closed, preventing bugs or odor from coming through the draining outlet.

It can be clearly seen that the present draining outlets equipped with two symmetric semi-circular blockage flaps that are pivotally openable downwardly with water discharged through the central opening so that water will not flush against the wall of a draining duct 5, making the water discharged smoothly and easily. Besides, the slot-like opening of the supporting lugs facilitates the mounting of the blockage flaps by simply snapping the pivot pin of each blockage flap into the supporting lug via the slot-like opening.

I claim:

1. An improved draining outlet structure mainly mounted on a floor above a draining duct, comprising a fixing board, a draining outlet, a top cover; said fixing board having a central through hole in which said draining outlet is disposed and said top is placed on the top of said draining outlet; a pair of symmetric supporting lugs being disposed on the bottom outer periphery of said draining outlet; each said supporting lug having a slot-like opening; a pair of semi-circular flat blockage flaps being disposed at the bottom of said draining outlet, keeping said outlet in a closing manner as water is not discharged therethrough; each of said blockage flaps having a counterweight on one side and within an outer periphery thereof and a pivot pin on the reverse side thereof in snap engagement with said slot-like opening of said supporting lug so as to permit each said blockage flap to pivotally open and automatically close due to the gravity exerted on said counterweight after water is discharged, wherein said counterweight is located between said pivot pin and an inner periphery of said draining duct.

* * * * *